US006581912B2

(12) United States Patent
Connelly, Jr. et al.

(10) Patent No.: US 6,581,912 B2
(45) Date of Patent: Jun. 24, 2003

(54) JACK ASSEMBLY FOR SUPPORTING A SHELTER STRUCTURE

(75) Inventors: Patrick Joseph Connelly, Jr., Natick, MA (US); Scott Douglas Dixon, Natick, MA (US); James Richard Cullinane, Upton, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/874,764

(22) Filed: Jun. 5, 2001

(65) Prior Publication Data

US 2002/0145136 A1 Oct. 10, 2002

Related U.S. Application Data

(60) Provisional application No. 60/281,915, filed on Apr. 5, 2001.

(51) Int. Cl.[7] ..... B66F 3/10

(52) U.S. Cl. ..... 254/102; 254/98; 254/100

(58) Field of Search ..... 254/98, 100, 102, 254/133, 131, 101, DIG. 1, 424

(56) References Cited

U.S. PATENT DOCUMENTS

| | | | | | |
|---|---|---|---|---|---|
| 459,769 | A | * | 9/1891 | Russell | 254/102 |
| 1,457,825 | A | * | 6/1923 | Devan | 254/102 |
| 1,585,291 | A | * | 5/1926 | Jordan | 254/102 |
| 2,069,012 | A | * | 1/1937 | Lynes | 254/102 |
| 3,308,587 | A | * | 3/1967 | Gilroy | 254/102 |
| 3,398,933 | A | * | 8/1968 | Haroldson | |
| 3,810,603 | A | * | 5/1974 | Metz | 254/100 |
| 3,945,300 | A | | 3/1976 | Bourges | |
| 4,471,944 | A | | 9/1984 | Leray et al. | |
| 4,520,981 | A | | 6/1985 | Harrigan | |
| 4,601,454 | A | | 7/1986 | Mattsson | |
| 4,629,163 | A | * | 12/1986 | Miller | 254/133 R |
| 4,969,301 | A | * | 11/1990 | Warden | 52/108 |
| H1823 | H | * | 12/1999 | Wolford | 254/98 |

FOREIGN PATENT DOCUMENTS

| | | | | |
|---|---|---|---|---|
| FR | 537886 | * | 7/1921 | 254/102 |
| SU | 1104102 | * | 7/1984 | 254/102 |

* cited by examiner

*Primary Examiner*—Joseph J. Hail, III
*Assistant Examiner*—Daniel Shanley
(74) *Attorney, Agent, or Firm*—Vincent J. Ranucci

(57) ABSTRACT

A jack assembly for supporting a shelter structure includes a first tubular member fixed at a first end thereof to a plate, a nut disposed in the first tubular member and fixed to the plate, the plate defining a central hole aligned with a central hole in the nut, and a threaded shaft extending through the plate central hole and threadably engaged with the nut, the shaft having thereon a flat sided base portion. A second tubular member is telescopically mounted on and moveable on the first tubular member to elongate the assembly, and a lock member is provided for locking the second tubular member to the first tubular member in a position in which the first and second tubular members overlap and the lock member is disposed in a region of the overlap.

11 Claims, 3 Drawing Sheets

JACK ASSEMBLY FOR SUPPORTING A SHELTER STRUCTURE

This application claims the benefit of Provisional application Ser. No. 60/281,915 filed Apr. 5, 2001.

STATEMENT OF GOVERNMENT INTEREST

The invention described herein may be manufactured and used by and for the Government of the United States of America for Governmental purposes without the payment of any royalties thereon.

BACKGROUND OF THE INVENTION

1. Field of the Invention

The invention relates to jack assemblies and is directed more particularly to such assemblies adapted to support shelter structures.

2. Description of the Prior Art

In the U.S. Army there is currently used a Modular Extendable Rigid Wall Shelter (MERWS) jack assembly for supporting the MERWS. The jack assembly is of low profile when fully retracted, when the height of the assembly is about 8½–9 inches. The low profile is required for ease of packaging for shipment. The jack assembly, when fully extended, is of an overall length of about 32½–33 inches. The jack thus has a "throw" of about two feet, which is needed to accommodate variations in terrain on which the MERWS is erected in the field.

The current MERWS jack consists of multiple telescopically mounted threaded pipe sections, and is relatively expensive to manufacture. The current MERWS jack has exhibited a tendency toward binding at threaded interfaces, leading to increased time to deploy and time required for maintenance.

Accordingly, there is a need for an improved MERWS jack assembly which is less expensive to manufacture, less likely to bind, and which provides reduced time required for deployment and maintenance.

SUMMARY OF THE INVENTION

An object of the invention is, therefore, to provide an improved jack assembly for use with modular shelters, the assembly being less expensive to manufacture, less likely to bind, and requiring less time for deployment and maintenance.

With the above and other objects in view, a feature of the present invention is the provision of a jack assembly for supporting a shelter structure. The assembly comprises a first tubular member fixed at a first end thereof to a plate, a nut disposed in the first tubular member and fixed to the plate, the plate defining a central hole aligned with a central hole in the nut, and a threaded shaft extending through the plate central hole and threadedly engaged with the nut, the shaft having thereon a flat sided base portion. A second tubular member is telescopically mounted on and moveable on the first tubular member to elongate the assembly, and a lock member is provided for locking the second tubular member to the first tubular member in a position in which the first and second tubular members overlap and the lock member is disposed in a region of the overlap.

In accordance with a further feature of the aforesaid invention, the threaded shaft extends through the nut, and the flat sided base portion of the threaded shaft is adapted for engagement with a wrench by which the shaft may be turned in the nut to selectively increase and decrease the length of the assembly.

In accordance with a still further feature of the aforesaid invention, an end of the threaded shaft within the first tubular member is provided with a wrench connector, such that a wrench extended through the second tubular member is enabled to engage the wrench connector and turn the threaded shaft in the nut to selectively increase and decrease the length of the assembly.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
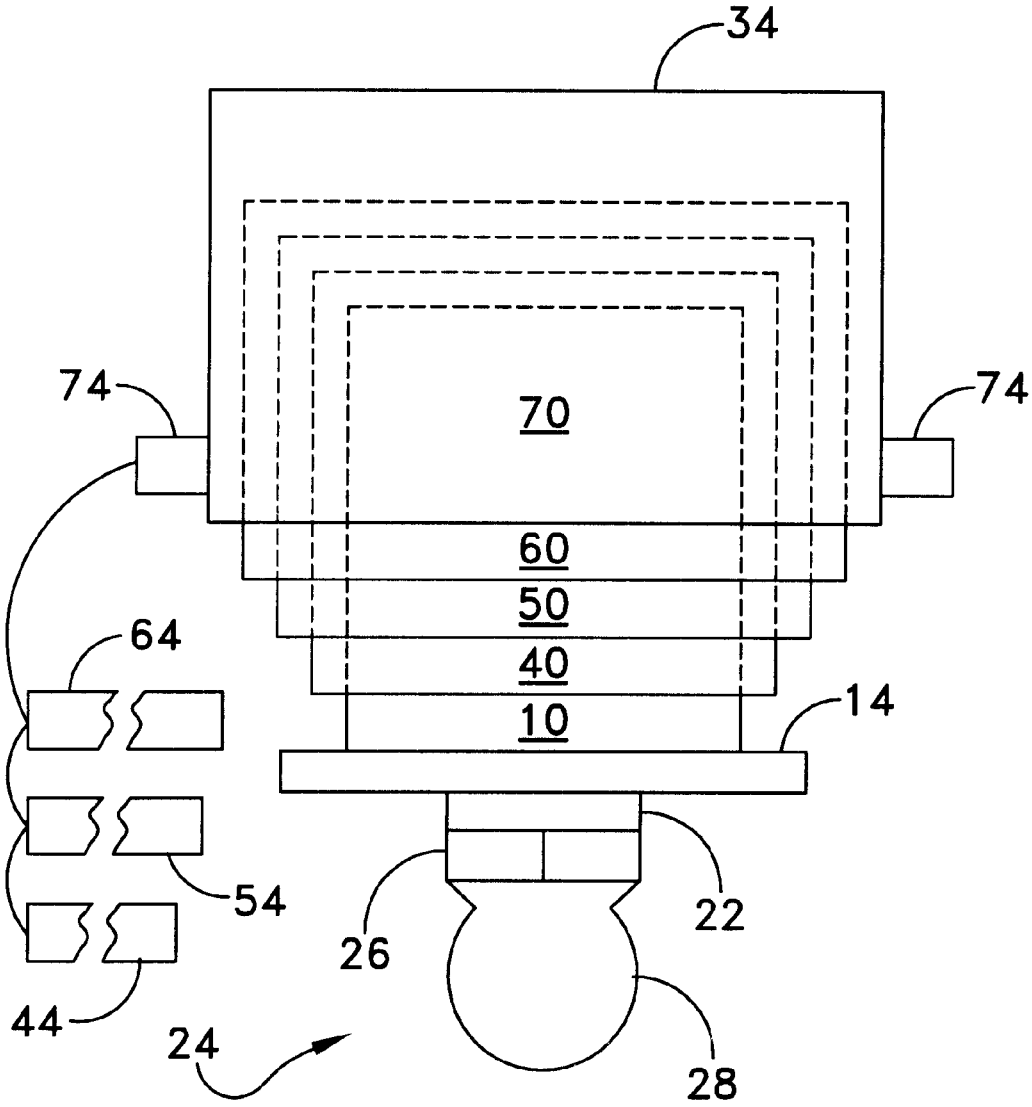
FIG. 1 is a side elevational view of one form of jack assembly illustrative of an embodiment of the invention, wherein the assembly is shown in a fully retracted condition.
Figure 2:
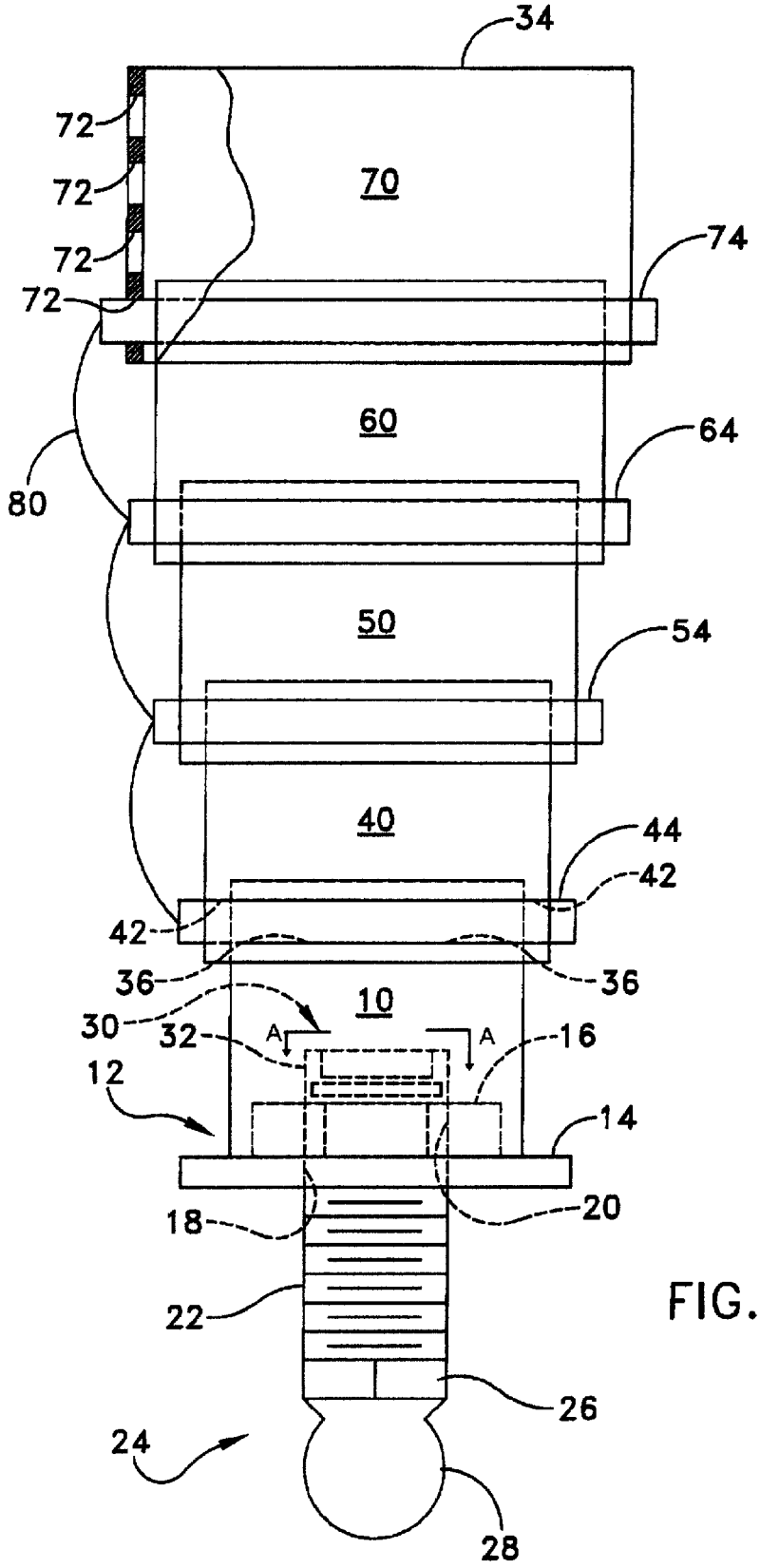
FIG. 2 is a side elevational view of the jack assembly of FIG. 1, wherein the assembly is shown in a fully extended condition.

Referring to FIGS. 1 and 2, it will be seen that the illustrative assembly includes a first tubular member 10 fixed at an end 12 thereof to a plate 14. A nut 16 is disposed within the tubular member 10 and is fixed to the plate 14. The plate 14 defines a central hole 18 which is aligned with a central hole 20 of the nut 16.

A threaded shaft 22 extends through the plate central hole 18, is threadably engaged with the nut 16, and extends through the nut 16 and into the first tubular member 10. Near a distal end 24 of the shaft 22, the shaft is provided with a flat-sided base portion 26 which is adapted for engagement with a wrench (not shown) by which the shaft 22 may be turned in the nut 16 to selectively increase and decrease the overall length of the assembly. The distal end 24 of the shaft 22 is provided with a ball-shaped projection 28 which can be received by a socket in a base plate (not shown).

Figure 2A:
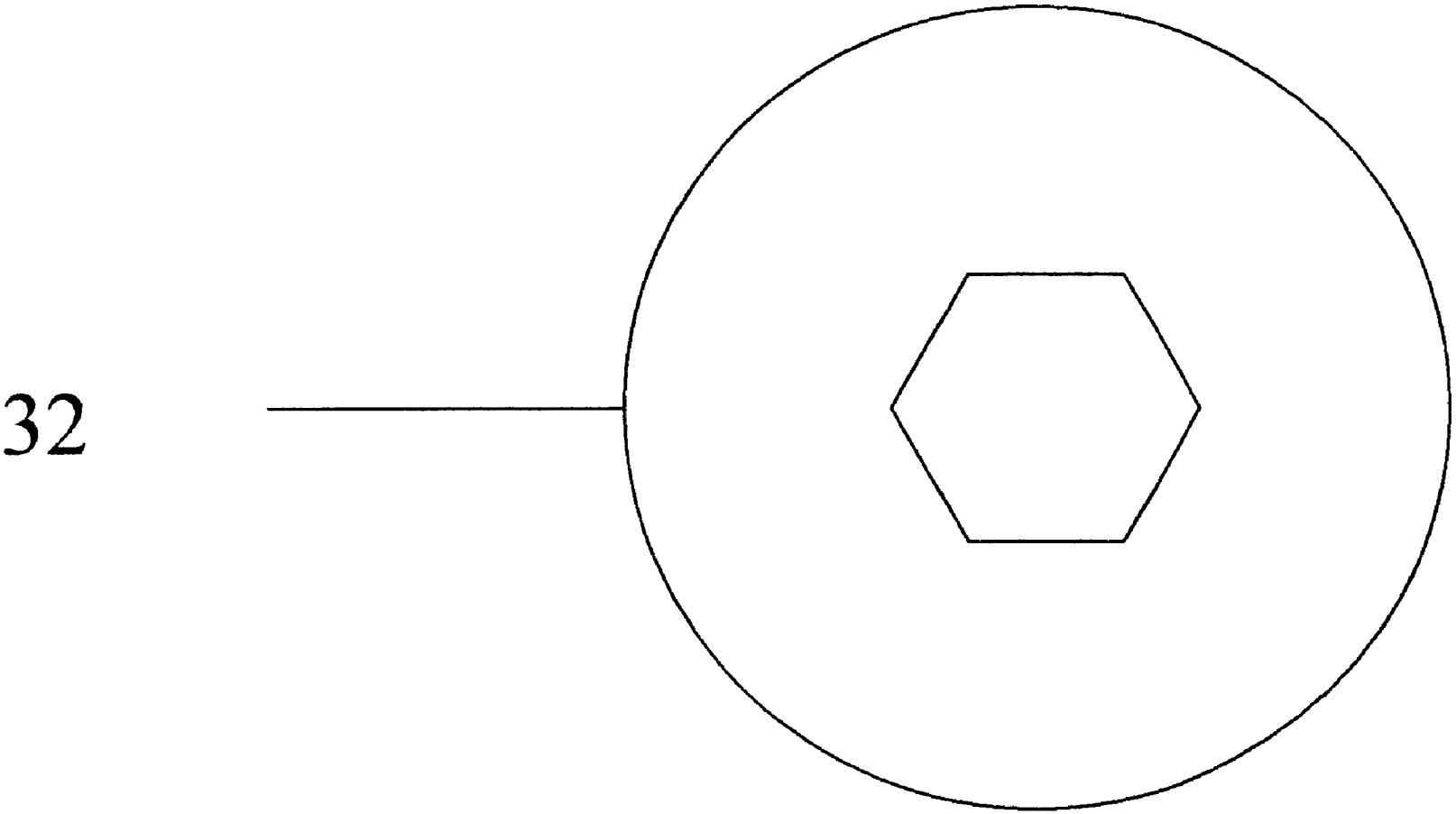
FIG. 2A is a plan view of the wrench connector shown along A—A in FIG. 2.

The shaft 22 at the other end 30 thereof is provided with a wrench connector 32, also shown in FIG. 2A, which is adapted to receive a wrench (not shown) extended through the assembly from an open upper end 34 thereof, such that the wrench is engageable with the wrench connector 32 to turn the threaded shaft 22 in the nut 16 to selectively increase and decrease the overall length of the assembly.

Thus, the assembly may be modified in length by either turning the shaft flat-sided base portion 26 or by turning the shaft at its wrench connector end 32.

A second tubular member 40 is telescopically mounted on, and is moveable on, the first tubular member 10 to elongate the assembly described hereinabove. To lengthen the assembly, the second tubular member 40 is moved on the first tubular member 10 from the position shown in FIG. 1 to the position shown in FIG. 2.

To lock the second tubular member 40 on the first tubular member 10, both tubular members are respectively provided with a series of holes 36, 42 therein, selected ones of which are aligned to receive a locking pin 44. The tubular members 10, 40 overlap such that a pair of the holes 36 can be aligned with a pair of the holes 42, allowing the locking pin 44 to be extended through the tubular members 10, 40.

Similarly, additional tubular members 50, 60 and 70 may be telescopically mounted on the second tubular member 40 and lockable into selected positions by further locking pins 54, 64 and 74 placed in aligned holes. Inasmuch as the pins 44, 54, 64 and 74 are of different lengths, it has been found helpful to interconnect the pins of a set of pins by a lanyard 80. In operation, the ball-shaped projection 28 is placed in the recess in the base plate (not shown). Starting with the outermost tubular member 70, the tubular members are extended and locked in place so as to approximate the assembly length desired. Inasmuch as the location of the MERWS typically is in the field, the heights of the jack assemblies can be quite varied. Support beams (not shown) are placed on the upper ends 34 of the jack assemblies. The beams are leveled by turning of the shaft 22 to effect fine adjustments.

As noted above, the shaft 22 may be turned from either the top of the assembly, by way of the wrench connector 32, or the side, near the bottom, of the assembly, by way of the flat-sided base portion 26. In practice, it has been found that peripheral jack assemblies are easily fine tuned by using the flat-sided base portion 26, while the interior jack assemblies are more easily adjusted by extending a wrench down through the assembly and engaging the wrench connector 32.

Thus, the jack assemblies are first set at an approximate length, or height, and subsequently are adjusted to obtain a precise level. Inasmuch as the tubular members are not threaded, binding between members is essentially eliminated and the cost of production is substantially reduced. Further, inasmuch as there is no threaded interconnection of tubular members, they need not necessarily be round in cross-section, but may be square or of any advantageous cross-section.

It is to be understood that the present invention is by no means limited to the particular construction herein disclosed and/or shown in the drawings, but also comprises any modifications or equivalents within the scope of the claims.

What is claimed is:

1. A jack assembly for supporting a shelter structure, the assembly comprising:

a first tubular member fixed at a first end thereof to a plate;

a nut disposed in said first tubular member and fixed to the plate, the plate defining a central hole aligned with a central hole in said nut;

a threaded shaft extending through the plate central hole and threadably engaged with said nut, said shaft having thereon a flat sided base portion;

a second tubular member telescopically mounted on and moveable on said first tubular member to elongate the assembly; and a lock member for locking said second tubular member to said first tubular member in a position in which said first and second tubular members overlap and said lock member is disposed in a region of the overlap.

2. The jack assembly in accordance with claim 1 wherein the flat sided base portion of said threaded shaft is adapted for engagement with a wrench by which said shaft may be turned in said nut to selectively increase and decrease a length of the assembly.

3. The jack assembly in accordance with claim 1 wherein said threaded shaft extends through said nut and at an end of said shaft within said first member is provided with a wrench connector, such that a wrench extended through said second member is enabled to engage with the wrench connector to turn said threaded shaft in said nut to selectively increase and decrease a length of the assembly.

4. The jack assembly in accordance with claim 1 wherein said lock member comprises a pin insertable through aligned holes in said overlap region of said first and second members.

5. The jack assembly in accordance with claim 1 wherein a distal end of said threaded shaft, outwardly of the flat sided base portion is provided with a generally spherical projection.

6. The jack assembly in accordance with claim 1 and further comprising a third tubular member telescopically mounted on and moveable on said second tubular member, and a second lock member for locking said third tubular member to said second tubular member in a position in which said second and third tubular members overlap and said second lock member is disposed in a region of the second and third members' overlap.

7. The jack assembly in accordance with claim 6 and further comprising further tubular members telescopically mounted on and moveable relative to said third tubular member, and further lock members for locking said further tubular members in positions further lengthening the assembly.

8. The jack assembly in accordance with claim 7 wherein all of said tubular members are telescopically retractable such that all of said tubular members are disposed around said first tubular member to provide a compact assembly.

9. The jack assembly in accordance with claim 8 wherein the fully retracted compact assembly is about 8.5–9 inches in length and when fully extended is about 32.5–33 inches in length.

10. The jack assembly in accordance with claim 7 wherein each of said lock members comprises a pin for extending through holes in two adjacent overlapping tubular members.

11. The jack assembly in accordance with claim 10 wherein all of said pins are connected one to another by a lanyard.

* * * * *